US010059125B2

(12) United States Patent
Okumura

(10) Patent No.: US 10,059,125 B2
(45) Date of Patent: Aug. 28, 2018

(54) RECORDING APPARTUS WITH SUPPORT UNIT SUPPORTING MEDIUM TRANSPORT BELT

(71) Applicant: SEIKO EPSON CORPORATION, Tokyo (JP)

(72) Inventor: Naoyuki Okumura, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/430,836

(22) Filed: Feb. 13, 2017

(65) Prior Publication Data

US 2017/0239960 A1 Aug. 24, 2017

(30) Foreign Application Priority Data

Feb. 19, 2016 (JP) ..... 2016-029420

(51) Int. Cl.
*B41J 11/04* (2006.01)
*B65H 20/06* (2006.01)
*B65H 5/02* (2006.01)

(52) U.S. Cl.
CPC ..... *B41J 11/04* (2013.01); *B65H 5/025* (2013.01); *B65H 20/06* (2013.01); *B65H 2404/2614* (2013.01)

(58) Field of Classification Search
CPC ..... B41J 11/04; B65H 20/02; B65H 20/06; B65H 5/025; B65H 2404/2614
See application file for complete search history.

(56) References Cited

U.S. PATENT DOCUMENTS 5,883,654 A * 3/1999 Katsuyama ..... B65H 20/02 347/104
2006/0098074 A1* 5/2006 Nakashima ..... B41J 11/007 347/104
2011/0050825 A1 3/2011 Murata et al.
2015/0060239 A1 3/2015 Uno et al.
2015/0239263 A1 8/2015 Ishizuka
2016/0288533 A1 10/2016 Ishizuka

FOREIGN PATENT DOCUMENTS

EP 2754560 A1 7/2014
JP 2009-256811 A 11/2009
JP 2011-051165 A 3/2011
JP 2014-148157 A 8/2014
JP 2014-185004 A 10/2014
JP 2015-050505 A 3/2015
JP 2015-157269 A 9/2015

OTHER PUBLICATIONS

The Extended European Search Report for the corresponding European Patent Application No. 17155477.7 dated Jul. 13, 2017.

* cited by examiner

*Primary Examiner* — Henok Legesse

(57) ABSTRACT

Provided is a recording apparatus that includes a transport belt for transporting a medium, a pressing roller configured to press the medium against the transport belt, and a support portion capable of supporting the transport belt. In the stated recording apparatus, the transport belt and the support portion make contact with each other when the pressing roller is pressed against the medium. By making the recording apparatus have the constitution as described above, it is possible to make the transport belt support the medium with certainty and suppress an increase in friction force between the transport belt and the support portion capable of supporting the transport belt.

6 Claims, 5 Drawing Sheets

RECORDING APPARTUS WITH SUPPORT UNIT SUPPORTING MEDIUM TRANSPORT BELT

BACKGROUND

1. Technical Field

The present invention relates to printing apparatuses.

2. Related Art

Various types of recording apparatuses have been used. Among them, such recording apparatuses are disclosed that include a transport belt for transporting a medium and perform recording on the medium transported by the stated transport belt.

For example, JP-A-2009-256811, JP-A-2015-157269, and JP-A-2011-51165 disclose ink jet recording apparatuses that perform recording by ejecting ink onto a medium which is transported by a transport belt.

SUMMARY

There are various types of structures adopted by recording apparatuses that include a transport belt for transporting a medium. For example, there are provided recording apparatuses equipped with a pressing roller (paste roller, pressure roller) configured to press the medium against the transport belt as disclosed in JP-A-2009-256811 and JP-A-2015-157269, a recording apparatus equipped with a support unit (attraction platen) capable of supporting the transport belt as disclosed in JP-A-2011-51165, and so on.

By adopting a structure including a pressing roller configured to press the medium against the transport belt and a support unit capable of supporting the transport belt, the medium can be supported by the transport belt with certainty. However, a friction force between the transport belt and the support unit is increased in some cases, depending on the adopted structure.

An advantage of some aspects of the invention is to make a transport belt support a medium with certainty and suppress an increase in friction force between the transport belt and a support unit capable of supporting the transport belt.

In order to solve the above issues, a recording apparatus according to a first aspect of the invention includes a transport belt for transporting a medium, a pressing roller configured to press the medium against the transport belt, and a support unit capable of supporting the transport belt; the transport belt and the support unit make contact with each other when the pressing roller is pressed against the medium.

According to this aspect, the transport belt, the pressing roller, and the support unit are included, and the transport belt and the support unit make contact with each other when the pressing roller is pressed against the medium. In other words, in the case where the pressing roller needs to be pressed against the medium at a recording time or the like, the medium can be pressed against the transport belt with certainty by causing the transport belt and the support unit to make contact with each other; in the case where the pressing roller does not need to be pressed against the medium at a non-recording time or the like, the transport belt and the support unit can be distanced from each other, a contact force between the transport belt and the support unit can be weakened, and so on. This makes it possible not only to cause the transport belt to support the medium with certainty, but also to suppress an increase in friction force between the transport belt and the support unit capable of supporting the transport belt by making the transport belt and the support unit distanced from each other, weakening a contact force between the transport belt and the support unit, and so on when the pressing roller does not need to be pressed against the medium.

A recording apparatus according to a second aspect of the invention is such that, in the first aspect, the transport belt and the support unit are distanced from each other when the pressing roller is distanced from the medium.

According to this aspect, the transport belt and the support unit are distanced from each other when the pressing roller is distanced from the medium. This makes it possible to suppress the increase in friction force between the transport belt and the support unit capable of supporting the transport belt by making the transport belt and the support unit distanced from each other when the pressing roller does not need to be pressed against the medium.

A recording apparatus according to a third aspect of the invention is such that, in the first or second aspect, the pressing roller is pressed against the medium under its own weight.

According to this aspect, the pressing roller is pressed against the medium under its own weight. This makes it possible to easily form a mechanism that presses the pressing roller against the medium.

A recording apparatus according to a fourth aspect of the invention is such that, in any one of the first to third aspects, a force of equal to or less than half the own weight of the pressing roller is applied to the support unit when the pressing roller is pressed against the medium.

According to this aspect, a force of equal to or less than half the own weight of the pressing roller is applied to the support unit when the pressing roller is pressed against the medium. In other words, the force applied to the support unit, when the pressing roller is pressed against the medium, is reduced to be equal to or less than half the own weight of the pressing roller. This makes it possible to suppress the increase in friction force between the transport belt and the support unit capable of supporting the transport belt.

A recording apparatus according to a fifth aspect of the invention is such that, in any one of the first to fourth aspects, the pressing roller can move along a movement direction intersecting with a direction in which the pressing roller is pressed against the medium.

According to this aspect, the pressing roller can move along the movement direction intersecting with a direction in which the pressing roller is pressed against the medium. In other words, a situation where the pressing roller makes contact with the medium at the same position for a long time can be suppressed by moving the pressing roller along the movement direction when the pressing roller is pressed against the medium. This makes it possible to suppress the formation of a contact mark due to the pressing roller being pressed against the medium.

A recording apparatus according to a sixth aspect of the invention is such that, in the fifth aspect, the support unit has a support range equal to or larger than a movement range of the pressing roller in the movement direction.

According to this aspect, the support unit has the support range equal to or larger than the movement range of the pressing roller in the movement direction. This makes it possible for the support unit to support the transport belt, which is pressed by the pressing roller with the medium interposed therebetween, across the overall movement range of the pressing roller.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to an embodiment of the invention will be described in detail with reference to the accompanying drawings.

First, an outline of a recording apparatus 1 according to an embodiment of the invention will be described.

Figure 1:
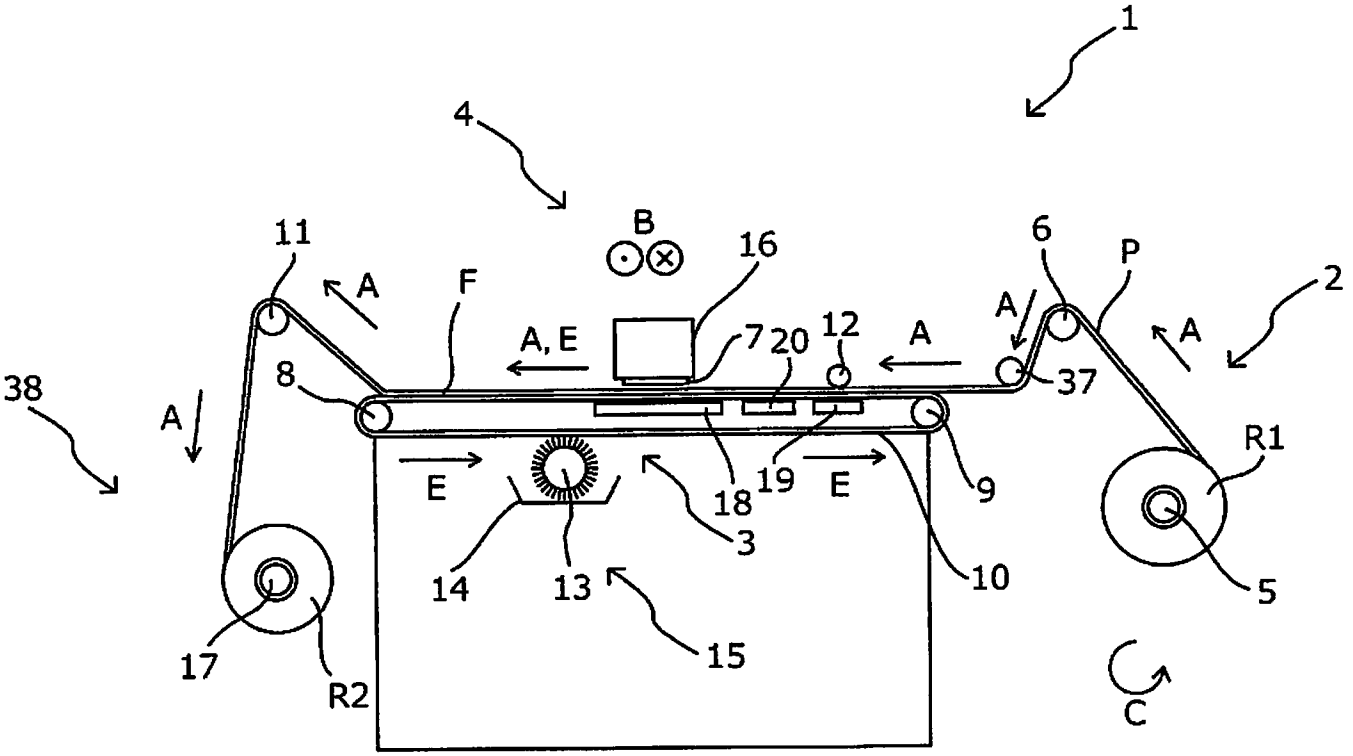
FIG. 1 is a schematic side view illustrating a recording apparatus according to an embodiment of the invention.

FIG. 1 is a schematic side view of the recording apparatus 1 according to the embodiment.

The recording apparatus 1 of the embodiment includes: a feeding section 2 capable of feeding out a roll R1 of a target recording medium (medium) P on which recording is performed; a transport mechanism 3 configured to transport the target recording medium P in a transport direction A using an adhesive belt 10 (a transport belt constituted of an endless belt) that supports the target recording medium P on a support surface F to which an adhesive agent is attached; a recording mechanism 4 configured to record on the target recording medium P by causing a carriage 16 equipped with a recording head 7 for ejecting ink to scan back and forth in a reciprocating movement direction B which intersects with the transport direction A of the target recording medium P; a washing mechanism 15 of the adhesive belt 10; and a winding mechanism 38 having a winding shaft 17 for winding the target recording medium P.

The feeding section 2 includes a rotational shaft 5 that serves as a setting position of the roll R1 of the target recording medium P on which recording is performed. The feeding section 2 is so constituted as to be capable of feeding out the target recording medium P from the roll R1 which is set on the rotational shaft 5, via slave rollers 6 and 37, to the transport mechanism 3. The rotational shaft 5 rotates in a rotational direction C when feeding out the target recording medium P to the transport mechanism 3.

The transport mechanism 3 includes the adhesive belt 10 which transports the target recording medium P fed out from the feeding section 2 while placing the target recording medium P thereon, a driving roller 8 for moving the adhesive belt 10 in a direction E, and a slave roller 9. The target recording medium P is pressed against the support surface F of the adhesive belt 10 by a pressing roller 12 to be pasted and placed on the support surface F. The driving roller 8 rotates in the rotational direction C when transporting the target recording medium P.

Note that the endless belt serving as the transport belt is not limited to an adhesive belt. For example, an electrostatic attraction-type endless belt may be used instead.

On a lower side of the adhesive belt 10 of this embodiment, a platen 18 and support portions 19, 20 are provided as a support unit capable of supporting the adhesive belt 10. Because of the adhesive belt 10 being supported by the platen 18 and the support portions 19 and 20, vibration of the adhesive belt 10 due to the movement of the adhesive belt 10, or the like can be suppressed. Here, the platen 18 is provided in a region opposing the recording head 7 with the adhesive belt 10 interposed therebetween, the support portion 19 is provided in a region opposing the pressing roller 12 with the adhesive belt 10 interposed therebetween, and the support portion 20 is provided between the platen 18 and the support portion 19.

The pressing roller 12 of the embodiment is so constituted as to be capable of moving back and forth (swinging) along the transport direction A in order to suppress a situation where a contact mark is formed on the target recording medium P due to the pressing roller 12 making contact with the target recording medium P at the same place for a constant time. This will be explained later in detail. Note that, however, the pressing roller 12 is not limited to the above-mentioned constitution.

The recording mechanism 4 includes a carriage motor 30 (see FIG. 2) to move the carriage 16 equipped with the recording head 7 back and forth in the reciprocating movement direction B. Note that the reciprocating movement direction B is a direction perpendicular to the depiction in FIG. 1 (i.e. is into and out of the plane of the sheet on which FIG. 1 is depicted).

At the time of recording, recording is performed while making the carriage 16 equipped with the recording head 7 scan back and forth. However, during the scanning in the recoding (during the movement of the carriage 16), the transport mechanism 3 stops the transport of the target recording medium P. To rephrase, at the time of recording, the reciprocating scanning of the carriage 16 and the transport of the target recording medium P are carried out alternately. In other words, at the time of recording, in response to the reciprocating scanning of the carriage 16, the transport mechanism 3 intermittently transports the target recording medium P (intermittently moves the adhesive belt 10).

Although the recording apparatus 1 of this embodiment includes the recording head 7 configured to eject ink while moving back and forth in the reciprocating movement direction B, a printing apparatus including what is called a line head in which a plurality of nozzles for ejecting ink are provided in an intersection direction intersecting with the movement direction of the target recording medium P may be employed instead.

Here, "line head" refers to a recording head used in a recording apparatus, where a nozzle region formed in the intersection direction intersecting with the movement direction of the target recording medium P is so provided as to be capable of covering the overall area in the intersection direction, and an image is formed by relatively moving the recording head or the target recording medium P. It may not be necessary that the nozzle region formed in the intersection direction of the line head be capable of covering the intersection direction of every medium that the recording apparatus corresponds.

The washing mechanism 15 of the adhesive belt 10 includes a washing brush 13 constituted of a plurality of washing rollers linked in a rotational shaft direction, and a tray 14 containing a washing agent for washing the washing brush 13.

The winding mechanism 38 is a mechanism for winding the target recording medium P, on which recording has been performed, that is transported from the transport mechanism 3 via a slave roller 11. In this case, a paper core or the like for winding the medium is set on the winding shaft 17 and then the target recording medium P is wound thereupon, whereby the target recording medium P can be wound as a roll R2 of the target recording medium P.

Next, an electric configuration of the recording apparatus 1 of this embodiment will be described.

Figure 2:
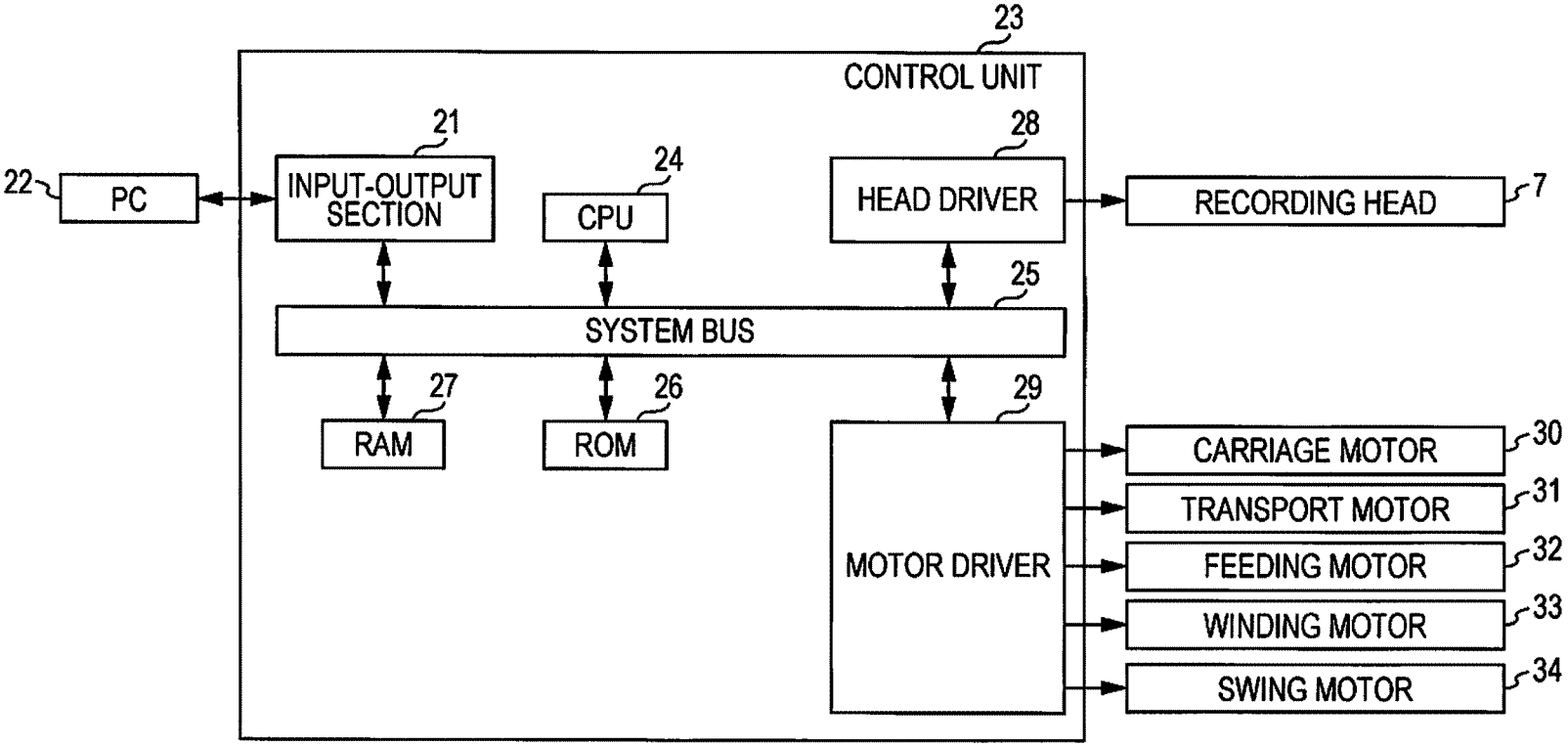
FIG. 2 is a block diagram illustrating a recording apparatus according to an embodiment of the invention.

FIG. 2 is a block diagram of the recording apparatus 1 of the embodiment.

In a control unit 23, a CPU 24 which supervises the overall control of the recording apparatus 1 is provided. The CPU 24 is connected, through a system bus 25, to a ROM 26 in which various control programs to be executed by the CPU 24, and the like are stored, and to a RAM 27 in which data can be temporarily stored.

Further, the CPU 24 is connected, through the system bus 25, to a head driver 28 configured to drive the recording head 7.

Furthermore, the CPU 24 is connected, through the system bus 25, to a motor driver 29 configured to drive a carriage motor 30, a transport motor 31, a feeding motor 32, a winding motor 33, and a swing motor 34.

The carriage motor 30 is a motor to move the carriage 16 equipped with the recording head 7. The transport motor 31 is a motor to drive the driving roller 8. The feeding motor 32 is a rotation mechanism of the rotational shaft 5, and is a motor to drive the rotational shaft 5 so as to send the target recording medium P to the transport mechanism 3. The winding motor 33 is a driving motor to rotate the winding shaft 17. Then, the swing motor 34 is a driving motor to swing (move back and forth) the pressing roller 12 along the transport direction A.

In addition, the CPU 24 is connected to the input-output section 21 through the system bus 25, and the input-output section 21 is connected to a PC 22 configured to send and receive data, such as recording data and the like, and signals.

The control unit 23, with the above-discussed constitution, can carry out the overall control of the recording apparatus 1.

Next, the pressing roller 12 and the support portion 19 as a principal portion of the recording apparatus 1 of the embodiment will be described.

Figure 3:
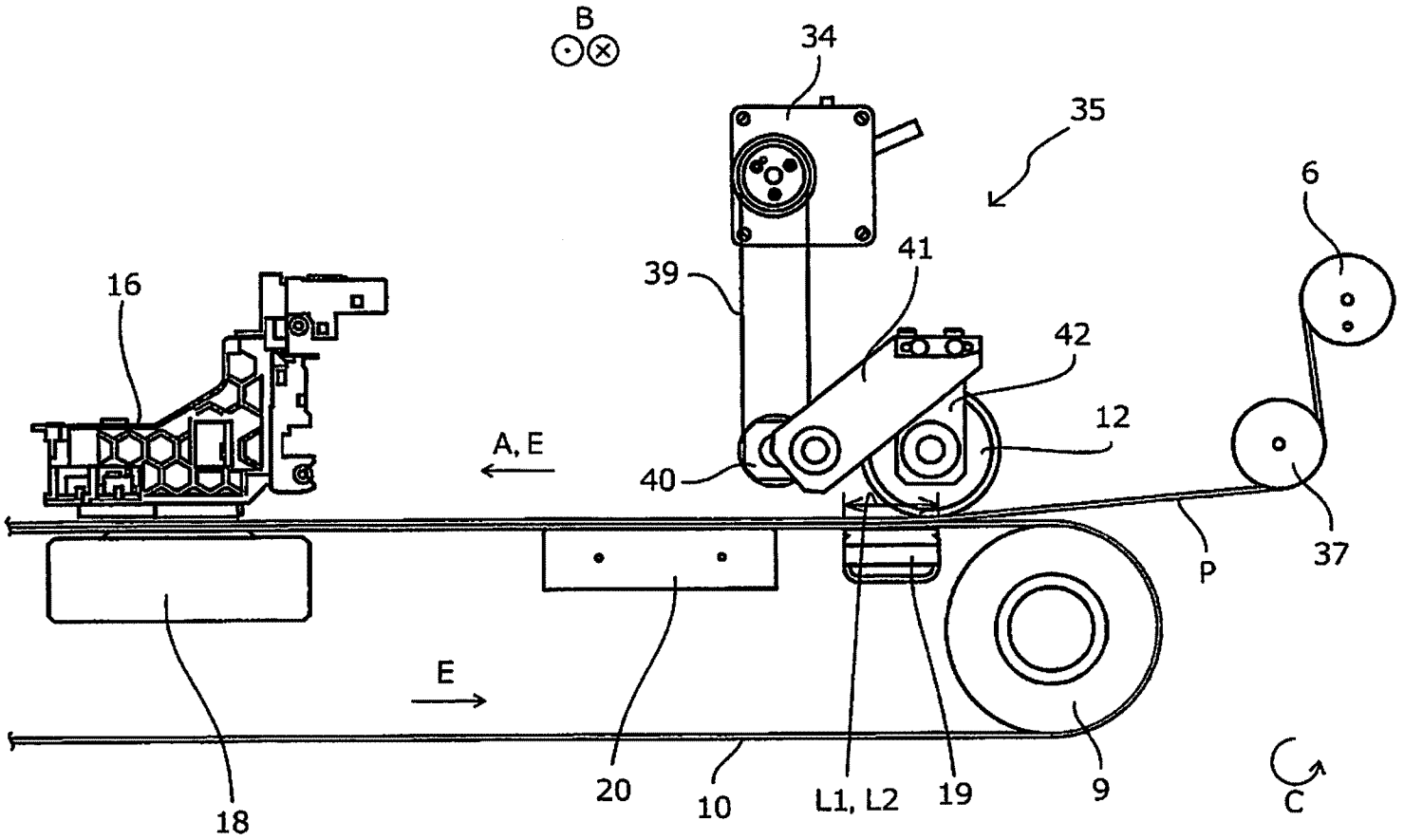
FIG. 3 is a schematic side view illustrating a principal portion of a recording apparatus according to an embodiment of the invention.

FIG. 3 is a schematic side view illustrating the periphery of the pressing roller 12 and the support portion 19 as a principal portion of the recording apparatus 1 of the embodiment.

Figure 4:
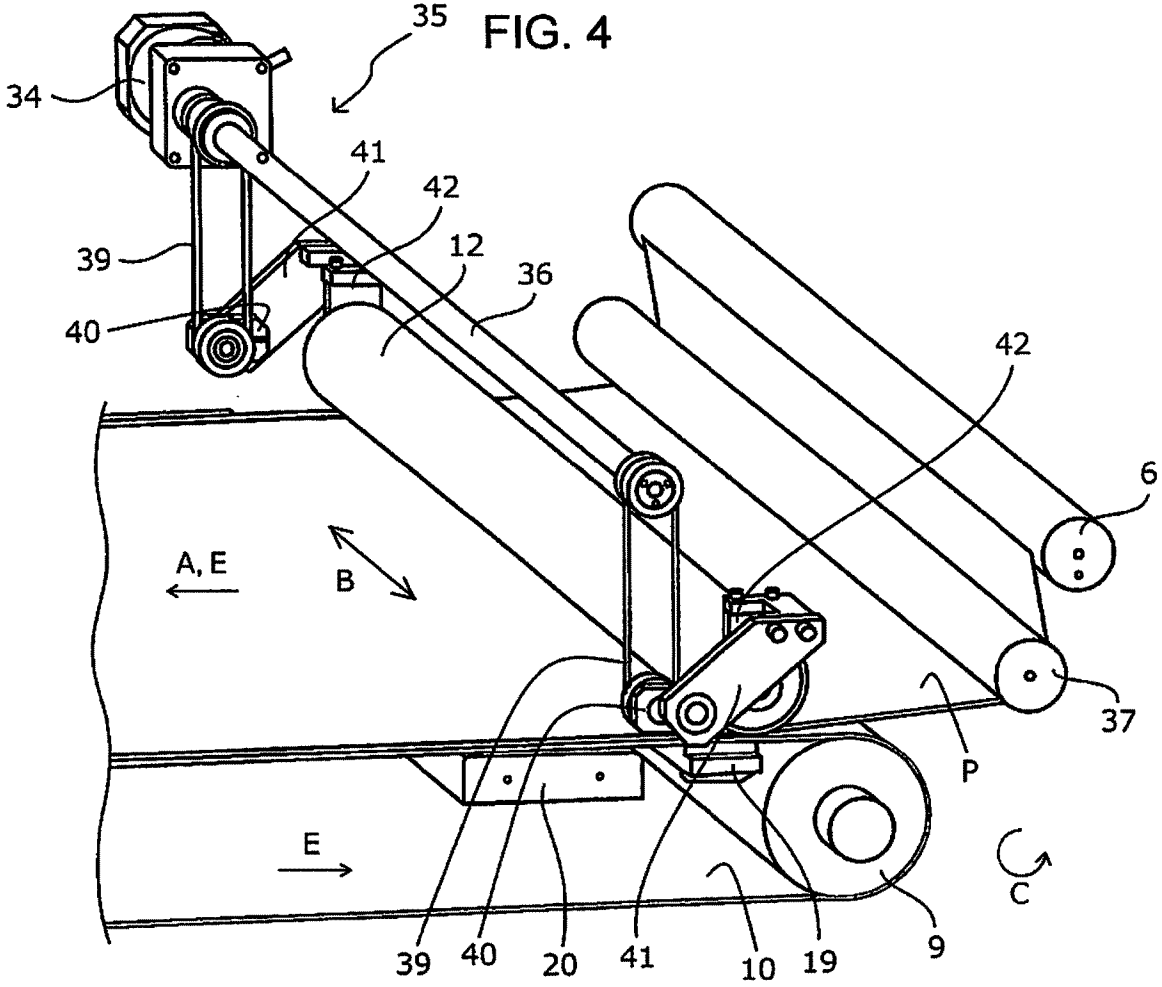
FIG. 4 is a schematic perspective view illustrating a principal portion of a recording apparatus according to an embodiment of the invention.

FIG. 4 is a schematic perspective view illustrating the periphery of the pressing roller 12 and the support portion 19 as a principal portion of the recording apparatus 1 of the embodiment.

Figure 5:
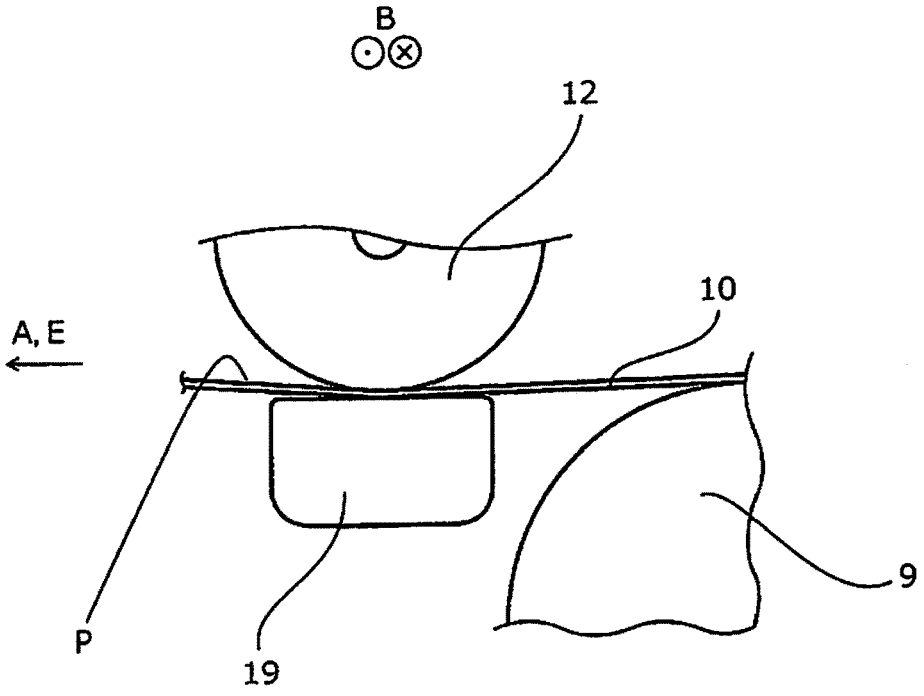
FIG. 5 is a schematic side view illustrating a principal portion of a recording apparatus according to an embodiment of the invention.
Figure 6:
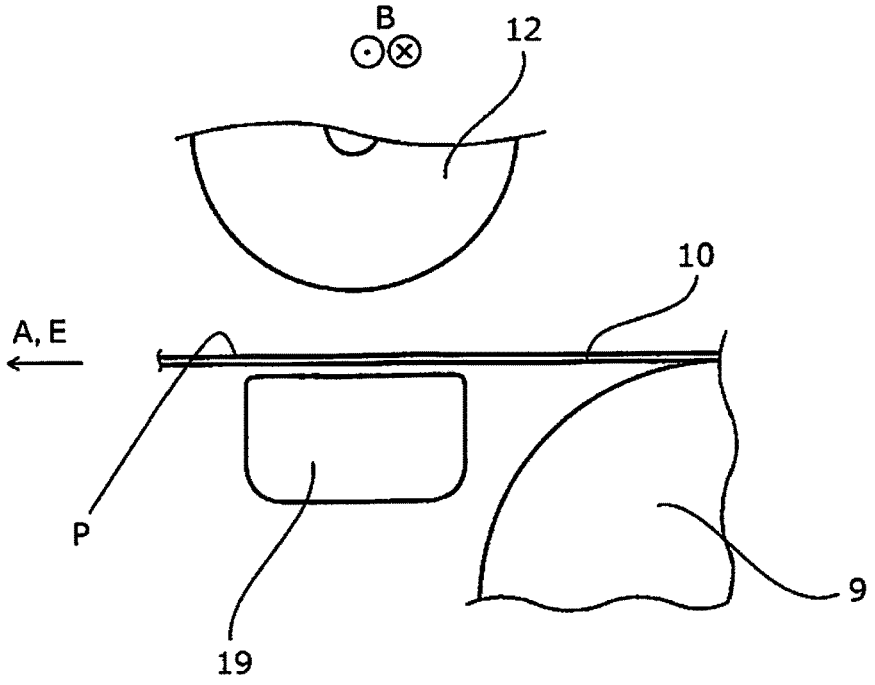
FIG. 6 is a schematic side view illustrating a principal portion of a recording apparatus according to an embodiment of the invention.

FIGS. 5 and 6 are schematic side views illustrating the periphery of the pressing roller 12 and the support portion 19; to be specific, FIG. 5 illustrates a state where the pressing roller 12 is pressed against the target recording medium P (adhesive belt 10), while FIG. 6 illustrates a state where the pressing roller 12 is distanced (spaced) from the target recording medium P (adhesive belt 10).

As discussed above, the support portion 19 is provided at a position opposing the pressing roller 12.

Here, as shown in FIGS. 3 and 4, the pressing roller 12 is connected to a second rotational member 40 via arm members 41 and 42. The second rotational member 40 is connected to the swing motor 34 via a belt 39 and a first rotational member 36. Then, a swing mechanism 35 is formed by the swing motor 34, the first rotational member 36, the belt 39, the second rotational member 40, and the arm members 41 and 42. In the recording apparatus 1 of the embodiment, driving the swing motor 34 rotates the first rotational member 36 in the rotational direction C, the rotation force of the first rotational member 36 is transmitted to the second rotational member 40 via the belt 39, and then the second rotational member 40 rotates in the rotational direction C, whereby the pressing roller 12 is swung, via the arm members 41 and 42, along the transport direction A in a movement range L1. It is to be noted that moving the pressing roller 12 in a direction in which the roller is distanced from the target medium P and fixing this state can be carried out by a raising mechanism (not shown) raising the pressing roller 12 and fixing the pressing roller 12 through locking operation by a lock mechanism (not shown).

The recording apparatus 1 of the embodiment includes, as discussed above, the adhesive belt 10 for transporting the target recording medium P, the pressing roller 12 configured to press the target recording medium P against the adhesive belt 10, and the support portion 19 capable of supporting the adhesive belt 10.

Then, as shown in FIG. 5 in which the state where the pressing roller 12 is pressed against the target recording medium P is illustrated, the adhesive belt 10 and the support portion 19 are so constituted as to be in contact with each other when the pressing roller 12 is pressed against the target recording medium P.

In other words, with the constitution as discussed above, in the case where the pressing roller 12 needs to be pressed against the target recording medium P at the recording time or the like, the target recording medium P can be pressed against the adhesive belt 10 with certainty by causing the adhesive belt 10 and the support portion 19 to make contact with each other; in the case where the pressing roller 12 does not need to be pressed against the target recording medium P at the non-recording time or the like, the adhesive belt 10 and the support portion 19 can be distanced from each other, or a contact force between the adhesive belt 10 and the support portion 19 can be weakened. This makes it possible not only to make the adhesive belt 10 support the target recording medium P with certainty, but also to suppress an increase in friction force between the adhesive belt 10 and the support portion 19 capable of supporting the adhesive belt 10 by making the adhesive belt 10 and the support portion 19 distanced from each other, or weakening the contact force between the adhesive belt 10 and the support portion 19, when the pressing roller 12 does not need to be pressed against the target recording medium P.

In the above-discussed constitution, as shown in FIG. 6 in which the state where the pressing roller 12 is distanced from the target recording medium P is illustrated, the recording apparatus 1 of the embodiment is constituted so that the adhesive belt 10 and the support portion 19 are distanced from each other when the pressing roller 12 is distanced from the target recording medium P. This suppresses the increase in friction force between the adhesive belt 10 and the support portion 19 capable of supporting the adhesive belt 10 by making the adhesive belt 10 and the support portion 19 be distanced from each other when the pressing roller 12 does not need to be pressed against the target recording medium P.

Further, in the recording apparatus 1 of this embodiment, the pressing roller 12 is so constituted as to be pressed against the target recording medium P under its own weight. This makes it possible to omit from additionally providing a pressure mechanism or the like in order to press (apply pressure to) the pressing roller 12 against the target recording medium P, whereby a mechanism to press the pressing roller 12 against the target recording medium P can be formed with ease.

Note that "to be pressed against the target recording medium P under its own weight" means that there is not provided an additional mechanism aiming at adjusting the pressing force (pressure force) when the pressing roller 12 is pressed against the target recording medium P.

The recording apparatus 1 of the embodiment is constituted so that only a force of equal to or less than half the own weight of the pressing roller 12 is applied to the support portion 19 when the pressing roller 12 is pressed against the target recording medium P by adjusting the tension of the adhesive belt 10 (tension produced by the adhesive belt 10 being hung across the driving roller 8 and the slave roller 9). In other words, the force applied to the support portion 19 when the pressing roller 12 is pressed against the target recording medium P, is reduced to be equal to or less than half the own weight of the pressing roller 12. This makes it possible to suppress the increase in friction force between the adhesive belt 10 and the support portion 19 capable of supporting the adhesive belt 10.

Although, in this embodiment, by adjusting the tension of the adhesive belt 10, the force applied to the support portion 19 is reduced to be equal to or less than half the own weight of the pressing roller 12, the force applied to the support portion 19 may be reduced to be equal to or less than half the own weight of the pressing roller 12 by using other methods.

As discussed thus far, the pressing roller 12 of the embodiment can move along the movement direction (along the transport direction A) intersecting with a direction in which the roller is pressed against the target recording medium P. With this constitution, when the pressing roller 12 is pressed against the target recording medium P, a situation where the pressing roller 12 makes contact with the target recording medium P at the same position for a long time can be suppressed by moving the pressing roller 12 along the transport direction A. As such, the recording apparatus 1 of the embodiment is constituted so that the formation of a contact mark due to the pressing roller 12 being pressed against the target recording medium P can be suppressed.

A support range L2 of the support portion 19 of the embodiment in a direction along the transport direction A has the same length as the movement range L1 (swing range) of the pressing roller 12 in a direction along the transport direction A (see FIG. 3).

It is preferable for the support portion 19 to have the support range L2 equal to or larger than the movement range L1 of the pressing roller 12 in a direction along the transport direction A. This is because using such constitution makes it possible for the support portion 19 to support the adhesive belt 10, which is pressed by the pressing roller 12 with the target recording medium P interposed therebetween, across the overall movement range L1 of the pressing roller 12.

Note that the invention is not limited to the above embodiment, and various modifications can be made within the scope of the invention as defined in the aspects of the invention; and it goes without saying that such modifications are also encompassed in the scope of the invention.

This application claims priority under 35 U.S.C. § 119 to Japanese Patent Application No. 2016-029420, filed Feb. 19 2016. The entire disclosure of Japanese Patent Application No. 2016-029420 is hereby incorporated herein by reference.

What is claimed is:

1. A recording apparatus comprising:

a transport belt configured to transport a medium;

a driving roller configured to support the transport belt;

a slave roller configured to support the transport belt;

a pressing roller configured to press the medium against the transport belt; and a support unit configured to support the transport belt between the driving roller and the slave roller, wherein the support unit is provided in a region opposing the pressing roller with the transport belt being interposed between the support unit and the pressing roller, the transport belt and the support unit make contact with each other when the pressing roller is pressed against the medium, and the transport belt and the support unit are separated from each other when the pressing roller is released from the medium.

2. The recording apparatus according to claim 1, wherein the pressing roller is pressed against the medium under its own weight.

3. The recording apparatus according to claim 1, wherein a force of equal to or less than half the own weight of the pressing roller is applied to the support unit when the pressing roller is pressed against the medium.

4. The recording apparatus according to claim 1, wherein the pressing roller is further configured to move along a movement direction intersecting with a direction in which the pressing roller is pressed against the medium.

5. The recording apparatus according to claim 4, wherein the support unit has a support range equal to or larger than a movement range of the pressing roller in the movement direction.

6. The recording apparatus according to claim 4, wherein the pressing roller is configured to move linearly along the movement direction, with the movement direction being a direction along a transport direction in which the medium is transported by the transport belt.

* * * * *